United States Patent [19]

Branscum

[11] 4,024,731

[45] May 24, 1977

[54] INSULATED CONTAINER WITH REFREEZABLE LID-MOUNTED BOTTLE

[75] Inventor: Tony E. Branscum, Winfield, Kans.

[73] Assignee: Gott Mfg. Co., Inc., Winfield, Kans.

[22] Filed: Oct. 31, 1975

[21] Appl. No.: 627,754

[52] U.S. Cl. ..... 62/457; 215/1 R; 220/17; 220/23; 220/72

[51] Int. Cl.[2] ..... F25D 3/08; B65D 23/00; B65D 25/00; B65D 7/42

[58] Field of Search ..... 62/457, 530, 371; 220/72, 23, 17; 215/1 R

[56] References Cited

UNITED STATES PATENTS

| | | | |
|---|---|---|---|
| 1,998,681 | 4/1935 | Littleford, Jr. | 62/457 |
| 3,255,607 | 6/1966 | Bair et al. | 62/457 |
| 3,406,532 | 10/1968 | Rownd et al. | 62/457 |
| 3,605,435 | 9/1971 | Taylor | 62/457 |
| 3,678,703 | 7/1972 | Cornish et al. | 62/371 |

FOREIGN PATENTS OR APPLICATIONS

| | | | |
|---|---|---|---|
| 1,007,563 | 10/1965 | United Kingdom | 220/72 |

*Primary Examiner*—Lloyd L. King
*Attorney, Agent, or Firm*—Lowe, Kokjer, Kircher, Wharton & Bowman

[57] ABSTRACT

A refreezable container for a cold storage structure which can be releasably secured to the lid of the structure is the subject of the present invention. The container comprises yieldable spaced apart sidewalls which form an enclosure for holding a refreezable liquid. A passageway through the enclosure and its sidewalls receives an elongated stud. The stud has a gripping surface at one end and is threaded on the other end. Along the length of the stud a lateral projection extends outwardly so that the combined dimension of the projection and the stud is greater than the corresponding dimension of the passageway. The yieldable passageway walls permit insertion of the stud which may then be turned to screw the threaded stud into a correspondingly threaded receptacle in the lid of the cold storage structure.

11 Claims, 4 Drawing Figures

INSULATED CONTAINER WITH REFREEZABLE LID-MOUNTED BOTTLE

This invention relates to the container art generally and, more particularly, to a container for holding a refreezable liquid for a cold storage structure.

Refreezable containers for cold storage compartments have long been known. Such containers are normally relatively small in capacity and are normally placed in a cold storage compartment at either the bottom thereof or together with the item being kept cool. In one known instance a refreezable container was formed as an integral portion of the lid of a cold storage compartment. The disadvantage of such a construction is that the entire lid must be placed in a freezer to refreeze the liquid causing substantial disadvantage to the user who needs to rely on the relatively small freezer compartment of a refrigerator. Such a construction is also difficult and expensive to manufacture.

It is a primary object of the present invention to provide a refreezable container for a cold storage compartment which may be locked into the lid of the compartment and also removed from the lid for refreezing.

Another object of the invention is to provide a refreezable container for a cold storage compartment which can be releasably locked to the lid of the compartment and wherein the locking means is carried by the container in a manner which precludes any possibility of loss of the locking means.

As a corollary to the above object, an important aim of the invention is to provide locking means for a refreezable container wherein the locking means may be permanently secured to the container after the latter is formed, thereby simplifying production requirements.

Other objects of the invention will be made clear or become apparent from the following description and claims when read in light of the accompanying drawings wherein:

Figure 1:
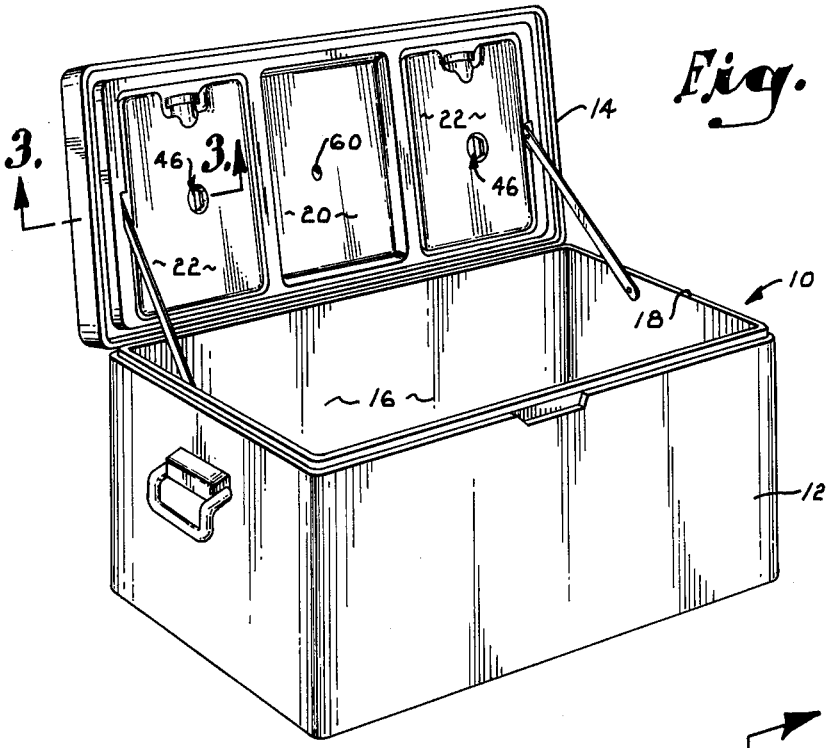
FIG. 1 is a perspective view of a cold storage compartment utilizing the refreezable containers of the present invention.

Referring initially to FIG. 1, a cold storage structure is designated generally by the numeral 10 and comprises a body portion 12 and a lid portion 14. The body portion 12 presents the storage area 16 and has an open top 18 which is closed by lid portion 14. The lid portion has three identical recessed areas which are designated by the numeral 20. Both body portion 12 and lid portion 14 are of "sandwich" construction with a central layer of insulating material 15 such as urethane foam.

Figure 2:
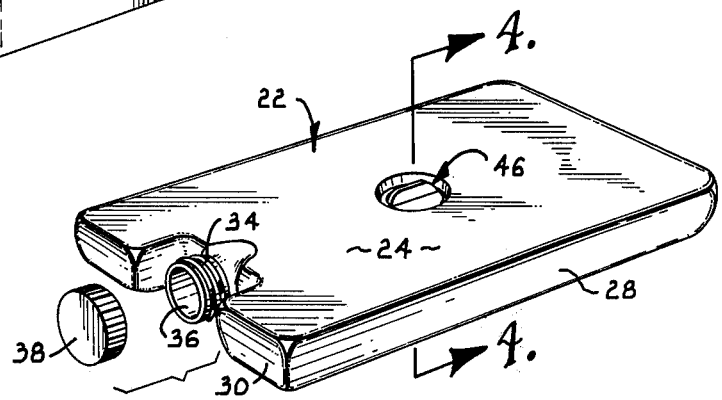
FIG. 2 is a perspective view, on an enlarged scale, of the refreezable container.
Figure 3:
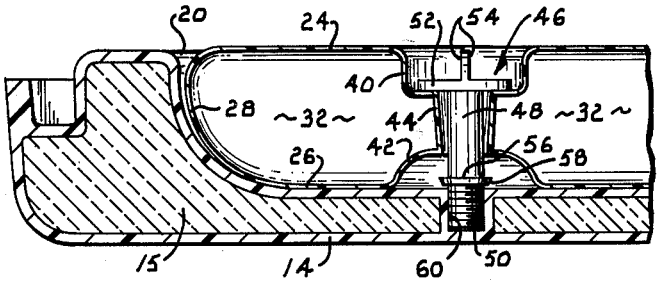
FIG. 3 is a cross-sectional view, on an enlarged scale, taken along line 3—3 of FIG. 1.

Referring additionally to FIGS. 2 and 3, the refreezable container is designated generally by the numeral 22. Container 22 is preferably formed from a moldable plastic material and has integral spaced apart sidewalls 24–30 which cooperate to define an enclosure 32. At one end of the enclosure, sidewalls 24 and 26 merge into a threaded neck 34 which presents a recessed opening 36 into the enclosure. Manifestly, container 22 is configured complementally to the configuration of recessed area 20. It is also desirable to form the container from a yieldable plastic to eliminate any danger of the container breaking when a liquid is frozen in it.

A first recessed section 40 is formed in sidewall 24 and is disposed in opposed, aligned relationship with a second recessed section 42 in sidewall 26. The two sections 40 and 42 are interconnected by a tubular section 44 having a frustoconical longitudinal, cross-sectional configuration. Sections 40–44 cooperate to present a passageway through enclosure 32 and sidewalls 24 and 26.

Container 22 is held rigidly in place within the recess area of lid 14 by a locking member designated generally by the numeral 46. Member 46 comprises an elongated stud shaft 48 having threads 50 at one end and an enlarged head 52 at the other end. Head 52 presents gripping surfaces 54 to facilitate turning of the member. Along shaft 48 toward the end having threads 50 is a lateral projection in the form of a circumscribing collar 56. Collar 56 is characterized by a beveled edge 58 which is complemental in configuration to the frustoconical configuration of the passage presented by section 44.

Figure 4:
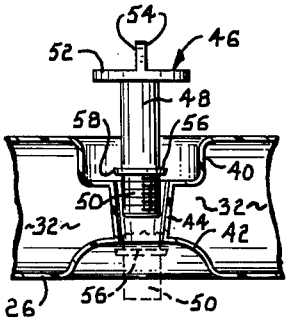
FIG. 4 is a fragmentary, cross-sectional view, on an enlarged scale, taken along line 4—4 of FIG. 2.

It will be appreciated that the diameter of tubular section 44, at its smallest point, is larger than the diameter of the shaft 48 and yet smaller than the diameter of shaft 48 plus collar 56. Thus, as member 46 is inserted into the passageway from the position illustrated in solid lines in FIG. 4, it is necessary to use substantial force to push the member all the way through the passage into the position shown in broken lines in FIG. 4. This is possible because container 22 including section 44 is made of yieldable plastic which will respond to the wedging forces exerted by collar 56 to yield to a degree to allow the collar to pass the narrowmost section of the passage. On the other hand, because of the frustoconical configuration of the passageway, it is virtually impossible to remove the member by pulling it back through the passage once it is in place. Thus, collar 56 serves as a retainer to hold the locking member to the container.

In each of the recessed areas 20 a female threaded receptacle 60 is provided. When the container is to be used for cooling structure 10, it is partially filled with a refreezable liquid such as water and frozen solid. The particular construction of container 22 with sections 40–44 forming a passageway through the container also serves to substantially strengthen the container as a result of the reinforcing effect which is achieved by these interconnected sections at the center of the container. Thus, unless the container is overfilled, it will not bulge at the center to a degree which would interfere with locking member 46.

After the liquid in the container has been frozen, the containers are placed within recessed areas 20 and locking member 46 may be rotated to screw threads 50 into receptacle 60 and rigidly mount the container within the lid.

It has been found that substantially superior cooling results are obtained by virtue of the fact that the cooling medium, contained within container 22, is located at the top of structure 10 in lid 14. Thus, as the heavier cool air settles to the bottom of structure 10, the entire contents including those near lid 14 will be cooled. Another advantage of the invention is that, by having a refillable container, it may be filled with a consumable liquid such as water or a flavored drink which is originally frozen and then may be consumed as it melts back into liquid form.

It should also be noted that the particular construction of container 22 with opening 36 in a recess location relative to the adjacent sidewalls 30 provides for maximum capacity of the container while also providing a substantially complete rectangle which, having four corners, helps to hold itself in position within recessed area 20.

While the invention has been shown with a cold storage structure 10 having three recessed areas 20 in its lid and two containers 22 positioned in the three recessed areas, it will be appreciated that in some instances three or more containers may be utili zed for a storage structure and, in other instances, with smaller storage structures, a single container positioned within a single recessed area of a smaller lid will provide adequate cooling capacity.

Having thus described the invention, I claim:

1. Structure for presenting a cold storage area, said structure comprising:

an open top body portion defining said area;

a lid portion adapted to be received by said body portion to close said open top, said lid presenting an open cavity on the side of the lid facing said area, means for presenting an enclosure having spaced apart flexible sidewalls and adapted to receive a freezable liquid, said enclosure presenting means being adapted to be received in said cavity, means for defining a passageway through said sidewalls and a portion of said enclosure;

a locking member received in said passageway; and means on said locking member for cooperating with the passageway defining means to prevent removal of said locking member from said passageway;

means on said lid portion for cooperating with said locking member to releasably lock said enclosure presenting means to said lid portion, said locking member being accessible upon opening of said lid whereby a user of said structure may operate said member to release said enclosure presenting means for insertion of the latter into a freezer compartment.

2. The invention of claim 1 wherein said passageway defining means comprises a first recessed section in one of said sidewalls; a second recessed section in the other of said sidewalls and a tubular section extending between said recessed sections.

3. The invention of claim 1, wherein said locking means comprises an elongated stud having an enlarged head presenting a gripping surface and said means on the locking member comprises a projection extending laterally from it; said tubular section having a cross-sectional dimension larger than the corresponding dimension of said stud and smaller than the corresponding dimension of the stud plus the lateral projection, said tubular section being yieldable to an extent to permit insertion of the stud and the lateral projection.

4. The invention of claim 3, wherein said tubular section is characterized by a frustoconical longitudinal cross-sectional configuration, said projection comprising a circumscribing collar having an edge with a bevel complemental in configuration to the sidewall of the tubular section.

5. The invention of claim 1, wherein said locking member comprises a threaded stud having an enlarged head presenting a gripping surface and said means on the lid portion comprises a threaded receptacle.

6. The invention of claim 5, wherein is included a plurality of said means for presenting an enclosure, a plurality of said means for defining a passageway, and a plurality of said locking members; said lid portion being provided with a plurality of said open cavities, there being one of said means on said lid portion for each of said cavities, and each of said enclosures being complemental in configuration to a corresponding open cavity.

7. The invention of claim 5 wherein said body portion and said lid portion are each provided with a layer of insulating material.

8. Structure for presenting a cold storage area, said structure comprising:

an open top body portion defining said area;

a lid portion adapted to be received by said body portion to close said open top, said lid presenting an open cavity on the side of the lid facing said area;

means for presenting an enclosure having spaced apart yieldable sidewalls and adapted to receive a freezable liquid, said enclosure presenting means being adapted to be received in said cavity; and a locking member for releasably locking said enclosure presenting means to said lid portion, said locking member being accessible upon opening of said lid whereby a user of said structure may operate said member to release said enclosure presenting means to permit freezing of the latter apart from said lid.

9. Structure as set forth in claim 8, wherein said locking member comprises a threaded stud on one of said lid portion and said enclosure presenting means, and threaded means for cooperating with said stud to lock the enclosure presenting means to the lid.

10. Structure as set forth in claim 9, wherein said enclosure presenting means includes means for defining a passageway through said sidewalls and said enclosure and said threaded stud extends through said passageway, said threaded means comprising a threaded opening in said lid.

11. Structure as set forth in claim 10, wherein is included means on said threaded stud for cooperating with the passageway defining means to prevent removal of said stud from said passageway.

* * * * *